United States Patent [19]

Oka et al.

[11] Patent Number: 4,821,071

[45] Date of Patent: Apr. 11, 1989

[54] ELECTROPHOTOGRAPHIC COPIERS

[75] Inventors: Tateki Oka, Toyokawa; Naoki Toyoshi; Hisashi Myochin, both of Toyohashi; Tomoaki Yokoyama, Toyokawa, all of Japan

[73] Assignee: Minolta Camera Kabushiki Kaisha, Osaka, Japan

[21] Appl. No.: 46,944

[22] Filed: May 7, 1987

[30] Foreign Application Priority Data

| | | | |
|---|---|---|---|
| May 9, 1986 | [JP] | Japan | 61-106923 |
| Nov. 13, 1986 | [JP] | Japan | 61-270596 |
| Nov. 13, 1986 | [JP] | Japan | 61-270597 |

[51] Int. Cl.[4] ..... G03G 15/00

[52] U.S. Cl. ..... 355/14 CH; 355/14 D; 355/14 R

[58] Field of Search ..... 355/14 CH, 14 E, 3 CH, 355/14 D, 14 R

[56] References Cited

U.S. PATENT DOCUMENTS

| | | | |
|---|---|---|---|
| 3,967,891 | 7/1976 | Rippstein | 355/3 R |
| 4,222,660 | 9/1980 | Furuichi et al. | 355/14 R |
| 4,466,732 | 8/1984 | Folkins | 355/14 D |
| 4,630,918 | 12/1986 | Yui et al. | 355/14 D |
| 4,634,259 | 1/1987 | Oishi et al. | 355/3 CH X |

FOREIGN PATENT DOCUMENTS

| | | |
|---|---|---|
| 51-134635 | 11/1976 | Japan . |
| 54-30833 | 3/1979 | Japan . |

*Primary Examiner*—A. T. Grimley
*Assistant Examiner*—Ed Pipala
*Attorney, Agent, or Firm*—Wenderoth, Lind & Ponack

[57] ABSTRACT

An improved electrophotographic copier is proposed which includes a first static charger; an image exposure unit; a second charger provided with a grid; and a developer having a developing electrode, all being arranged around a photosensitive rotatable drum.

The second charger is impressed selectively with an a.c. voltage or a d.c. voltage which has an opposite polarity to that applied to the first charger. The voltage impressed to the grid has same polarity with that which is applied to the first charger. The developing agent contained in the developer includes such statically charged toner as having an opposite polarity to that of static latent images formed on the drum surface. The copier operates selectively in standard copy mode or in marginal image outline formation mode. The developing service is nevertheless carried out in the normal manner, thus employing no reverse development mode.

10 Claims, 12 Drawing Sheets

ELECTROPHOTOGRAPHIC COPIERS

BACKGROUND OF THE INVENTION

1. Field of the Invention

This invention generally relates to electrophotographic copiers, and more specifically to those which are capable of providing selective operability for execution of either the regular standard copying mode or marginal image outline formation mode.

2. Prior Art

Generally speaking, the peripheral outline of an image is in practice full of necessary information thereabout and represents sufficiently the characterizing features of the image, thus playing among others a most important role in the judgement of the nature thereof. Further, it is to be noted that when a peripheral image outline is taken out and modified into a corresponding binary graphic representation, the latter has rather favorable characteristics in comparison with the corresponding regular, thick and page image representation, such as highly simplified and easier facilities for image identification; determination; transmission and the like. Therefore, the take-out of peripheral image outlines for conversion thereof into corresponding binary graphic representations is highly effective in image pattern recognition; image correction; image emphasis; band width compression and the like proceedings.

As an example, a complex color image pattern is rather attractive to realize by execution of two successive copying operations to provide a black pattern encircled by a color outline, or to prepare a blank pattern for the later producing differently colored local image areas contained therein.

It should be noted that in the name of the present assignee company, it has already been proposed to provide an outline image-forming process, wherein, in case of the mono-component type toner developing method using conductive toner to develop static latent images, said process is characterized in that, between the material to be subjected to developing and the carrier for the conductive toner, a d.c.-bias voltage is impressed at a medium potential ranging between the maximum and minimum surface potential of said material and having an opposite polarity to the static latent image charge, for extracting the outline marginal configuration only from the latent image on said material to be developed (refer to Japanese Open Patent Specification, unexamined, No. Sho-51-134635).

It should be further noted, however, that there is a considerable drawback in the above-mentioned prior art improvement. In this proposed process, the developed marginal outline image is only a negative one, because of the fact that the marginal outline of the static latent image is also negative and the conductive toner will be deposited onto a substantial part of the latent image other than the marginal outline thereof, and indeed, by virtue of higher potential difference charged at the substantive part of the latent image on the photosensitive drum. In practice, however, the wanted marginal outline should preferably be in black and thus positive. Therefore, the thus formed negative outline image must generally be subjected to a further reproducing step relying upon the reverse development principle, which represents naturally a grave and troublesome drawback inherent in improving the above known process.

SUMMARY OF THE INVENTION

It is, therefore, an object of the present invention to provide an improved electrophotographic copier which is capable of selective execution of either normal standard copy mode or peripheral image outline formation mode, for providing a peripheral image outline, having a satisfactory concentration, or an image.

A further object is to provide a photocopier having the capability of forming only the peripheral outline edge of a latent image by depositing toner substantially exclusively thereat, and transferring the toner image onto a copy paper for the formation of a sharp and thick marginal outline.

Still a further object is to provide an improved electrophotographic copier, capable of operating selectively either in standard copy mode or in marginal image outline formation copy mode, wherein said copier operates automatically in the standard copy mode upon execution of electrical energization thereof.

A further object is to provide an improved electrophotographic copier, wherein even if the marginal image outline formation mode has been set, the copier will operate in the standard copy mode, after a predetermined time period has elapsed without operational instruction upon completion or termination of said outline formation mode operation.

For fulfilment of the foregoing object, the copier machine according to the present invention comprises: a first static charger; an image exposure unit; a second static charger provided with a grid and a developer fitted with a developing electrode; characterized in that said second charger is impressed with either an alternating voltage or a d.c. voltage which is of opposite polarity to that applied onto said first static charger, a voltage impressed upon said grid having same polarity with that impressed on said first static charger and being lower than the surface potential of the static latent images formed by said image exposure unit and higher than the surface potential at imageless background portions; and said developer contains statically charged toner having an opposite polarity to the surface potential at said static latent image for execution of normal developing, and that said copier is selectively operable in either marginal image outline formation mode with operation of said second charger or in standard copy mode without operation of said second charger.

PREFERRED EMBODIMENTS OF THE INVENTION

In the following, several preferred embodiments of the invention and modifications thereof will be set forth referring to the accompanying drawings.

First Embodiment

Figure 1:
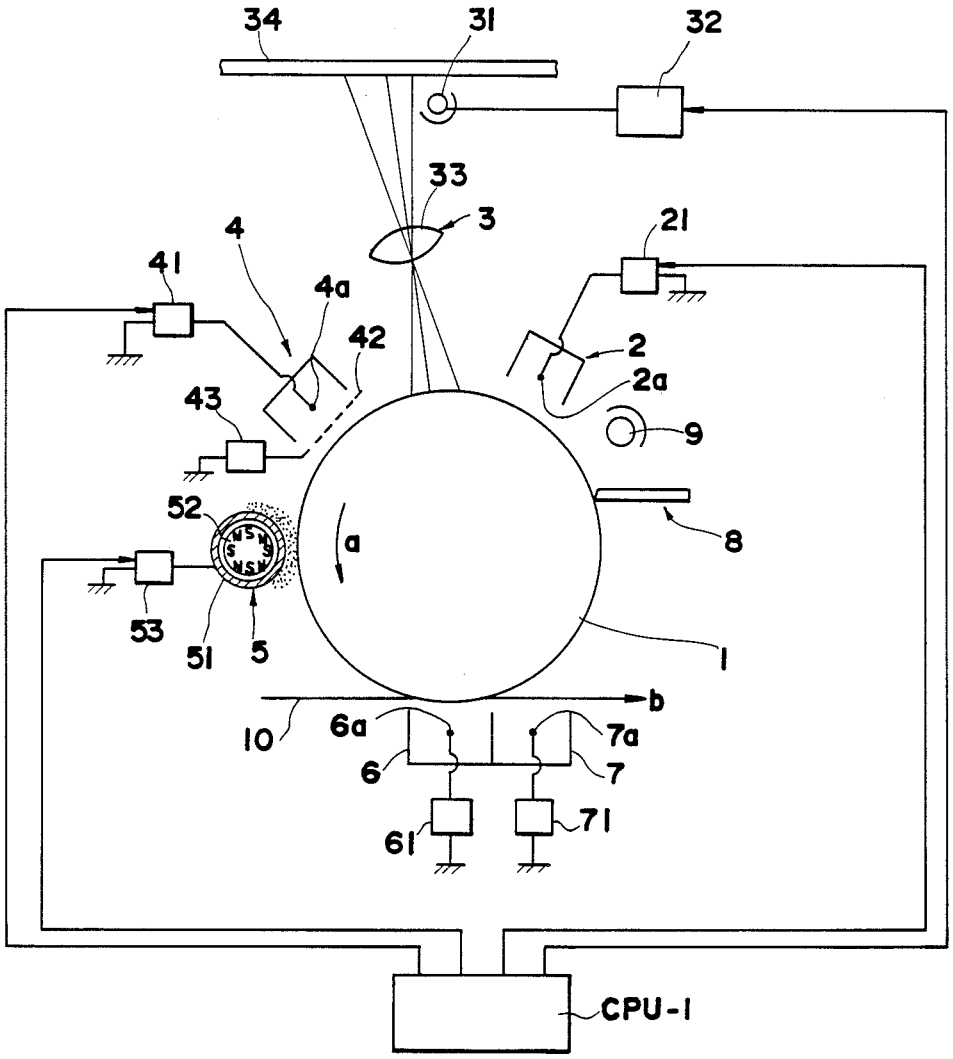
FIG. 1 is a schematic substantially elevational view of a first embodiment of an electronic photocopier according to the present invenion.

An electrophotographic copying machine according to a first embodiment of the present invention is shown in FIG. 1 in a schematic elevation view. In FIG. 1, numeral 1 designates a photosensitive drum of conventional design, having a photosensitive surface layer formed thereon, although not specifically shown and described. This drum 1 is driven to rotate in the counterclockwise direction in FIG. 1, as indicated by a small arrow "a", although the drive motor thereof has been omitted from the drawing because it is conventional. Around this drum, several constituent members and units, to be further described, are arranged.

Numeral 2 designates a static charger, to be referred to as the "first charger" throughout in this specification, and said first charger is so designed and arranged to charge the drum surface with a static charge of a predetermined constant potential. The first charger is provided for this purpose with a charge wire 2*a* which is electrically connected with a voltage source 21.

Numeral 3 designates a document image exposure unit which is composed of an exposure lamp 31, a reflecting mirror, not shown, a condenser lens 33 and the like, the lamp 31 being electrically connected with a current source 32. This document image exposure unit 3 projects light onto a document, not shown, preset on a movable document table 34 made of a transparent material, say, preferably glass. The reflected image light from the document is projected through condenser lens 33 onto the drum surface, whereby corresponding static latent images are formed thereon according to the known slit exposure principle.

Numeral 4 designates a scorotron charger which will be referred to as the "second charger" hereinafter, adapted for execution of a recharging of the drum surface which has had static latent images formed thereon. For this purpose, the second charger 4 is provided with a charge wire 4*a* connected electrically with a voltage source 41, while the related grid 42 is electrically connected with a separate voltage source 43. These related elements are designed and arranged such that the voltage impressed on charge wire 4*a* from voltage source 41 has an opposite polarity to that impressed upon static charger 2. Further, the voltage impressed upon grid 42 from voltage source 43 is selected to have the same polarity to that impressed upon static charger 2 and lower than the surface potential in the latent image area and higher than the surface potential in the imageless background area on the drum.

Numeral 5 designates a developer unit which representatively comprises a developing sleeve ring 51 containing therein a magnet roller 52 having a number of alternatingly and radially arranged N- and S-poles on its peripheral surface as shown, said developer 5, when energized, operating as a magnetic brush system as is highly well known. To the developing sleeve ring 51, a bias voltage source 53 is electrically connected for use in the developing operation. As the developing agent, a mixture of magnetic carrier and insulator toner is used connectional as connectional. These mixture constituents are charged with opposite polarities by friction charging. The insulator toner is charged to have an opposite polarity to that appearing at static charger 2.

When, as the insulator toner, a non-magnetic toner is used, developer sleeve ring 51 is impressed from the bias voltage source 53 with a developing bias voltage which is somewhat higher than the grid voltage and of same polarity as that appearing at the static charger 2.

On the contrary, when, as the insulator toner, a magnetic toner is used, developer sleeve ring 51 is impressed with a developing bias voltage which is lower than the grid voltage, and indeed, overlapped with an alternating voltage. It should be noted, however, that, in this case, use of insulator toner alone is possible. If wanted, further, in this case, the developing bias need not always overlap with the alternating voltage.

Numeral 6 designates a transfer charger which serves for applying an electrical field from behind onto a copy paper 10 which is being conveyed in a direction as shown by an arrow "b" and in contact with the drum surface, the tonered image(s) formed on the drum surface under the action of said developer unit 5 being transferred onto the copy paper. For this operation, charge wire 6*a* of transfer charger 6 is impressed from a voltage source 61 with a voltage which is of the opposite polarity to that of the insulator toner.

Numeral 7 designates a separation charger which serves for applying an alternating electrical field to the copy paper directly after being subjected to the image transfer as set forth above. In this way, removal of residual potential from copy paper 10 is executed, so as to separate the latter from the drum surface. For this purpose, charge wire 7*a* of the separation charger 7 is impressed with an alternating voltage from a.c.-voltage source 71.

Numeral 8 designates a cleaner unit, or briefly a cleaner, which serves for removing residual toner from the drum surface by relying upon the conventional blade system as is suggested in FIG. 1.

Numeral 9 designates an eraser lamp adapted for projecting light onto the drum surface for removal of residual static charge therefrom, in preparation for the next succeeding photo-copying operation.

Figure 3:
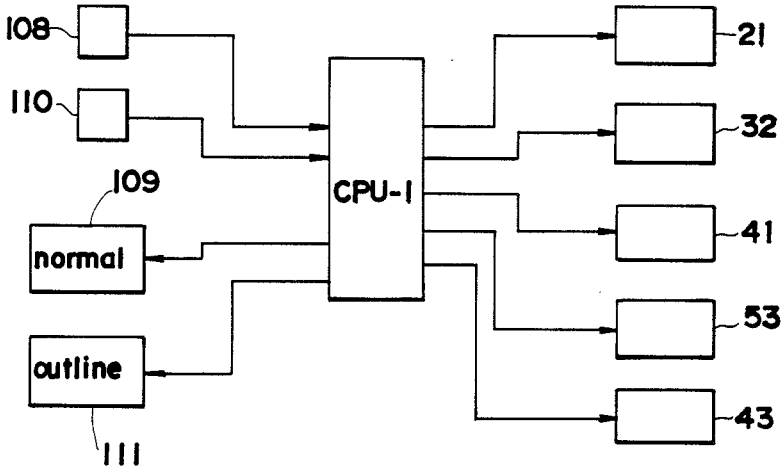
FIG. 3 is a block diagram of an operation control employed in the first embodiment.

Operation control of the present photo-copier machine is executed by a microcomputer CPU-1, acting as a control center. As shown in FIG. 3, on-off control of said voltage sources at 21; 41; 43; 53 and the like and voltage changeover control at voltage source 32, to be more fully described hereinafter, are executed under the action of this microcomputer CPU-1.

Figure 2:
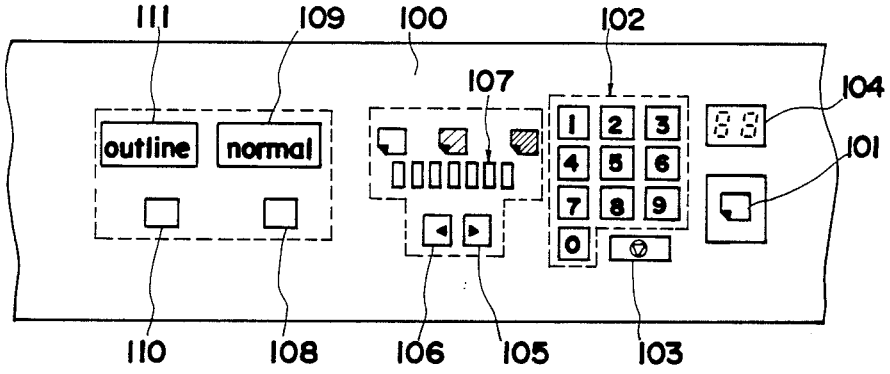
FIG. 2 is a schematic plan view of an operation control panel employed in said first embodiment copier.

In FIG. 2, an operation control panel 100 is shown. On this panel 100, a print key 101; ten keys 102; a clear/-stop key 103; and a display window 104 for showing print paper counts and the like. Further, up/down keys 105, 106 for adjustment of image density and a series of display LEDs 107 relating to these keys. Adjustment of image density can be executed, preferably by adjustment of light quantity of exposure lamp 31. 108 designates a standard copy mode selection key; 109 a display window therefor; 110 an image marginal outline formation mode selection key; and 111 a display window therefor. The foregoing various elements are electrically connected with the microcomputer CPU-1, as shown in FIG. 3.

At this stage of description, polarities and voltages of several foregoing chargers and the like, as employed in the present embodiment will be shown in the following.

[I] Use of non-magnetic insulator toner:

Static charger [voltage source 21]: positive, +5.5 kV;

Exposure light quantity by exposure lamp 31 and corresponding to imageless background on document (standard value)

For image marginal outline formation mode: 2.2 lx.sec.

For standard copy mode: 1.7 lx.sec.

Scorotron charger [voltage source 41]: negative, −6.0 kV;

Grid [voltage source 43]: positive, +220 V;

Developing bias [voltage source 53]: positive, +250 V;

Transfer charger [voltage source 61]: positive, +5.5 kV;

Non-magnetic and insulative toner: negative;

[II] With use of magnetic and insulative toner:

Static charger [voltage source 21]: positive, +5.5 kV;

Exposure light quantity from exposure lamp 31 and corresponding to imageless background on document (standard value)

For image marginal outline formation mode: 2.2 lx.sec.

For standard copy mode: 1.7 lx.sec.

Scorotron charger [voltage source 41]: negative, −6.0 kV;

Grid [voltage source 43]: positive +220 V;

Developing bias [voltage source 53]: positive (DC), +170 V; AC (350 Vrms, 1 kHz;

Initial developing potential: +250 V;

Magnetic and insulative toner: negative;

If neessary, however, all the foregoing voltage polarities may be reversed by one change. Additionally it is to be noted that foregoing voltages and exposure light quantities have been raised only by way of example.

In the following, the image forming process will be set forth in terms of the progressive steps. Image peripheral outline formation mode This image peripheral outline formation mode is executed with ON-operation of said selection key 110.

(i) First charging step:

By means of static charger 2, static charge of a predetermined potential level is applied onto the surface of photosensitive drum 1. As a result the surface potential of the drum 1 will amount to +600 V.

Figure 5:
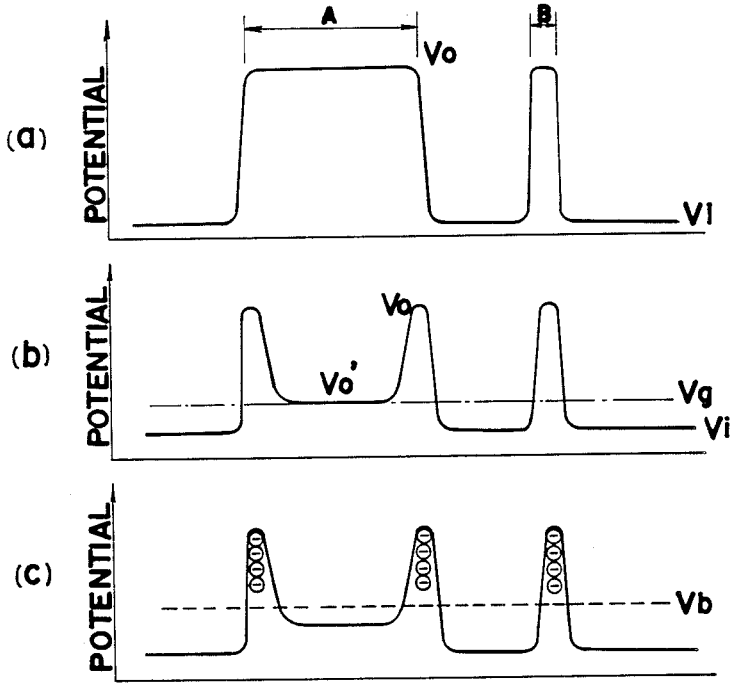
FIGS. 5 (*a*), (*b*) and (*c*), are potential diagrams at static latent image areas.

(ii) Exposure step:

On the surface of drum 1 precharged with a +600 V potential, document images are slit-exposed, so as to form corresponding latent images. In this case, as shown in FIG. 5(*a*), the electric charges corresponding to imaged area portions (A) and (B) remain at a +600 V potential, while those corresponding to imageless background areas will decrease to +90 V or so with exposure to a light quantity of 2.2 lx.sec.

The used document images were positive.

(iii) Second charging step:

The drum surface with latent images thereon as formed in the foregoing step is subjected to a recharging step by scorotron charger 4 impressed with a voltage of −6.0 kV from voltage source 41. At this stage, a voltage of +220 V is impressed on grid 42 from voltage source 43. The polarity of the voltage impressed on scorotron charger 4 is opposite to that impressed on static charger 2. Further, the voltage impressed on grid 42 is of the same polarity as that impressed on static charger 2 and thus lower than surface potential (+600 V) at static latent imaged areas (A) and (B), yet higher than the surface potential (+600 V) at the imageless background areas.

Figure 4:
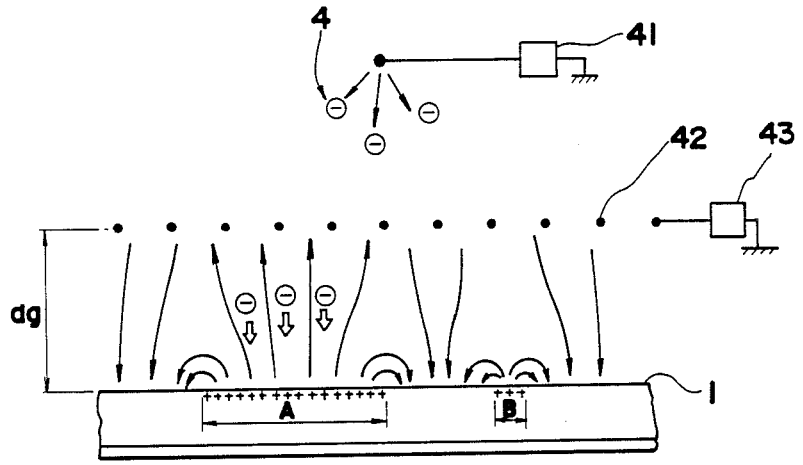
FIG. 4 is a schematic explanatory view, illustrating the action of lines of electric forces during operation of the second charger.

Between the drum surface and the grid 42, lines of electric force are formed as shown by a plurality of arrows in FIG. 4. The negative ions delivered from the charge wire will be subjected to the action of carrying forces directing along these lines of electric force. In this case, the lines of electric force urging the negative ions in the proximity of grid 42 towards the durm surface will appear only at a rather central portion of the broader or areal image area (A), other than inside the peripheral zone thereof. Thus, the negative ions will arrive only at the rather central portion of surface imaged area (A), other than the inside merginal zone thereof, for removal of residual charges at the ion-impinged areal portion, reducing them thus nearly to a potential level substantially equal to the grid voltage or +220 V.

Illustrating more specifically in terms of drum surface potentials, the surface potential (Vi) at the statically charged imageless background area(s) remains at a lower potential level of substantially +90 V, as shown at FIG. 5(*b*), while the potential in the band zone along the inside of the peripheral outline of a broad areal imaged portion (A) and that at an elongated band zone along a strip-like image portion (B), as an example, each having a substantially constant width, hold their initial surface potential without alteration, remaining at a substantially to a higher potential level (Vo) which is substantially +600 V. The rather central portion of the areal image portion (A) will lower its value to a level (Vo′) substantially equal to the grid voltage (Vg: +220 V). On the other hand, the surface potential (Vo) at the strip like image portion will generally be subjected to substantially no alteration, but the width of the charged band zone will be somewhat reduced.

In other words, as a result of this second charging step, marginal outlines of these imaged zones will be formed in form of static positive latent images.

(iv) Developing step:

In this stage, these static positive latent images representing the marginal outlines are subjected to a developing step by means of a developer 5. In the case when the insulative toner is not magnetic, a developing bias voltage of +250 V is applied to developing sleeve ring 51. This bias voltage has the same polarity as that applied to static charger 2, for the purpose of preventing otherwise possible attachment of fouling toner to or fogging not only at the rather central portion of areal latent imaged area, where the surface potential has been considerably lowered in the foregoing second charging step but also at the imageless background area(s). At the same time, the developing bias voltage is selected at this stage, not only to be somewhat higher than said grid voltage (Vg: 220 V), but also, to be a somewhat higher voltage (Vb) than the potential (Vo′) appearing at the rather central portion or off-marginal substantial part of the areal image area (A) where it has been considerably lowered nearly to be substantially equal to the grid voltage (Vg).

On the other hand, when the insulative toner is magnetic, developing sleeve ring 51 is impressed with a developing bias voltage: AC 350 V, 1 kHz and +170 V. This developing bias voltage is somewhat lower than the said grid voltage (Vg: +220 V) and at the same time lower than the potential (Vo') at the substantial part of areal imaged portion (A) which has been lowered to a value substantially equal to the grid voltage (Vg). However, with use of insulative and magnetic toner, the development will be initiated with such a surface potential of 250 V or so, on account of the very presence of a certain threshold value under the influence of magnetic binding forces. For this reason, otherwise frequent occurrence of disadvantageous fouling and fogging causing toner attachment onto substantial parts of static latent imaged areas where surface potential has considerably lowered in the foregoing second charging step, and naturally onto the remaining imageless background areas, can be effectively avoided.

On the other hand, negatively charged insulative toner will be attractingly deposited on the higher potential regions precharged at a potential level (Vo), of the drum surface or more specifically on the marginal oulines of imaged areas (A) and (B), thereby providing tonered images thereof in the manner of "outline edge trimming from inside" so to speak, and in the way of the regular developing process.

The thus formed toner images are then transferred onto a copy paper 10 by execution of negative discharge at transfer charger 6, the thus image-transferred copy paper being further conveyed through a fixer unit, not shown, and becoming the copied image-bearing paper or a final print.

(Standard copy mode)

The standard copy mode is executed upon the ON-operation of the mode selection key 108. Necessary initial control settings are also automatically set, although not specifically set forth.

(i) First charging step:

This step can be executed in a similar way as in the foregoing image peripheral outline formation mode.

(ii) Exposure step:

In this case, the exposure light quantity amounts to 1.7 lx. sec, which value is lower than that employed in the foregoing image peripheral outline formation mode. The charged potential corresponding to the imageless background areas is 150 V. The exposure light quantity for lowering the potential, (Vi), at the imageless background areas to 150 V is that which is proper and normal to be used in a regular developing step in the regular photo-printing operation.

(iii) Second charging step

In this case, both voltage sources 41 and 43 are operated to OFF, so that scolotron charger 4 is kept de-energized. Therefore, the positive static latent images formed during the foregoing exposure step will be carried as such to the next succeeding developing step.

(iv) Developing step:

This step is the same as in the image peripheral outline formation mode. In this step, negatively charged insulative toner is deposited on the image areas (A) and (B) shown by way of example in FIG. 5(*a*) and thus, tonered normal images in one-to-one relationship with those on the document will be provided through a normal developing step.

According to our precise study, it has been found that peripheral outline image conditions, especially the image density thereof, are strongly influenced by such operating elements as, for instance, initial surface potential (Vo); imageless background surface potential (Vi) and grid voltage (Vg); and mutual relationships thereamong, especially potential difference (Vg) and (Vi). As an example, when the potential difference between (Vg) and (Vi) has been set to a comparatively large value, favorable marginal outlines are provided, while with smaller values of this potential difference, only rather pale and small outlines were produced.

The reason therefor may be that on account of the very existence of said potential difference between (Vg) and (Vi), the lines of electrical force appearing between grid 42 and drum surface at 1 will be subjected to considerable modification. Or in other words, with a larger potential difference: (Vg)−(Vi), lines of electric force extending from edge portions of image areas to imageless background portions will be considerably increased. Thus at these edge portions, negative ions from the side of grid 42 could can not arrive so that the marginal outline image will be formed. And therefore, with an increased value of the potential difference: (Vg)−(Vi), it is more difficult for negative ions to arrive at the edge portions under consideration, and therefore, these portions will be kept at a higher potential level, whereby a higher quality marginal outline formation will be achieved and produce a satisfyingly better and thicker image.

Thus, in the marginal image outline formation mode, the energization of scorotron charger 4 for execution of recharging is added to the standard copy mode conditions, and further, in addition to the foregoing and in the case of the first embodiment of the present invention, the exposure light quantity at exposure unit 3 will be increased. As a result, the potential difference: (Vg)−(Vi), will become larger.

Various experiments have been made in accordance with the present first embodiment under the condition:

$$(Vg)-(Vi)=220-90=130\text{ V}$$

and it has been found that acceptable marginal image outline images of high concentration were obtained without difficulty.

However, when the exposure light quantity is not increased in the marginal image outline formation mode and instead substantially the same exposure light quantity as in the case of standard copy mode operation, or in other expression has the condition of:

$$[(Vg)-(Vi)=220-150=70\text{ V}],$$

only inferior peripheral outline images of somewhat low concentration and unacceptably smaller width are produced.

Generally speaking, and in the standard copy mode, an increase of exposure light quantity is employed as a countermeasure against photosensibility reduction of the electrophotosensitive member, or more specifically drum, or in the use of such an original document having colored or dull backgrounds, so as to prevent otherwise possible occurrence of fogging deposits of the toner. In these cases, however, the image concentration will generally be disadvantageously be subjected to a reduction. In the case of the first embodiment of the present invention, however, an increase of exposure light quantity is executed with no relationship to removal of fogging or fouling with toner. In the case of the present embodiment, an increase of the potential difference: (Vg)−(Vi) will produce an increase of concentration in the peripheral image outlines so produced.

Second Embodiment

In the peripheral image outline formation mode adopted in the present second embodiment, the second charger is energized to operate, while the initial charge potential (Vo) is lowered in comparison with that employed in the standard copy mode operation.

Figure 6:
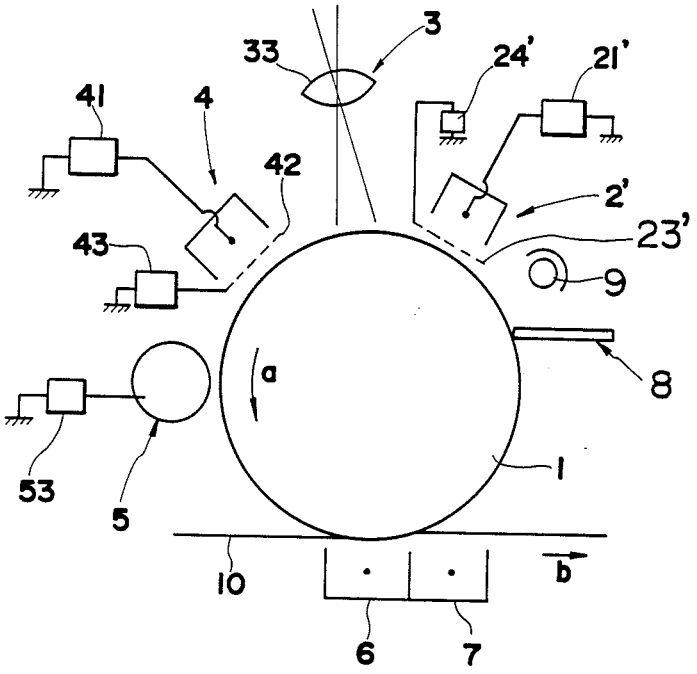
FIG. 6 is a schematic view similar to FIG. 1, yet showing a second embodiment of the invention.
Figure 7:
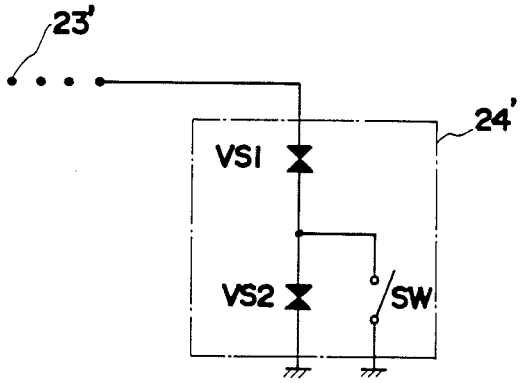
FIG. 7 is a schematic wiring diagram of a grid voltage control circuit for a first static charger employed in the second embodiment.

More specifically, as shown in FIGS. 6 and 7, scorotron charger 2' is used as the first charger, and voltage control circuit 24' for the grid 23' thereof is composed of varistors VS1 and VS2 and a switch SW connected to a junction point therebetween. This switch SW is grounded as shown. More specifically, the of standard copy mode operation, switch SW is off, and the grid 23' is impressed with a sum voltage (+600 V) through the series-connected varistors VS1 and VS2. In this operational mode, the drum surface initial charge potential (Vo) amounts to +600 V.

On the other hand, in the marginal image outline formation mode operation, switch SW is kept on, grid 23' is impressed with a partial voltage: +490 V through varistor VS1 only. In this case, the initial drum surface charged potential (Vo) will be reduced to 490 V.

In the next succeeding exposure step and in both operational modes, image exposure is carried out with an exposure light quantity of 1.7 lx.sec (standard value corresponding to document's imageless background areas) by the action of exposure unit 3. In this case, the potential (Vo') at imaged areas will be, as in the case of respective initial charge potential (Vo), held at +600 V in the standard copy mode operation, or at +490 V in the marginal image outline formation mode operation, while imageless background potential (Vi) will be reduced to +150 V and +110 V respectively.

Further operational steps are substantially same as in the first embodiment.

More specifically, in the peripheral image outline formation mode operation, scorotron charger 4 is held on and the recharging step is carried out with of grid voltage (Vg) held at +220 V. In the case standard copy mode operation, scorotron charger 4 is kept off without execution of a recharging step, while in both operation modes, a developing bias of +250 V is impressed, and the regular and normal developing is carried out. It should be noted that the foregoing numerical data are those which are employed when insulation toner is used.

More specifically, in the second embodiment, the potential difference (Vg)−(Vi) in case of marginal image outline formation mode amounts to 110 V (220−110). It has been found that under this operating condition, clear and well-defined outline images of sufficient concentration are formed.

On the contrary, if the initial charging potential (Vo) was set without reduction relative to that as adopted in the standard copy mode, the thus resulting peripheral outline images will have a rather lower concentration, resulting in a defective reproduction. The reason can be attributed to the smaller potential difference (Vg)−(Vi) having a value of 70 V (220−150).

As for the means for reducing the initial charging potential (Vo), a control of reduction of voltage control impressed by the static charger may be relied upon, instead of the foregoingly adopted grid voltage control at scorotron charger 2', resulting in a similar effective result according to our practical experiments.

Generally speaking, in the standard copy mode operation, the reduction of initial charging potential (Vo) is adopted for reducing the image density. On the contrary, in the the present second embodiment and by the reduction of initial charging potential (Vo), the concentration of the peripheral image outlines can be considerably elevated.

Third Embodiment

In the third embodiment, the second charger is energized in the peripheral image outline formation mode, and the developing bias voltage is elevated to a higher level than in the standard copy mode operation. Illustration thereof can be described with reference to FIG. 1.

More specifically, in the both operation modes, initial charging potential of +600 V is used and in the exposure step, the latent image in which the will be formed image area potential (Vo') amounts to +600 V, while the imageless background potential (Vi) is kept at a lower level of +150 V. The operation mode is briefly set forth as follows. In the standard copy mode, scorotron charger 4 is manipulated to ON, a recharging operation being thereby brought about at a grid voltage (Vg): +270. Next, a regular and normal developing operation is carried out, while impressing 250 V in standard copy mode operation. Or instead, in the peripheral image outline formation mode, a developing bias voltage of 300 V is applied for execution of the normal developing step. The specifically disclosed above numerical data have been employed with non-magnetic insulative toner.

In the present third embodiment, the potential difference: (Vg)−(Vi) in the marginal image outline mode operation amounts to 120 V (270−150). Under this condition a clear and well-defined marginal outline of satisfactory image concentration was provided.

On the contrary, when the marginal image outline formation mode a developing operation was executed by impressing a developing bias at 250 V in a similar way to that in the standard copy mode operation, only somewhat poor outline images of lesser concentration were produced. The reason therefor can be attributed to fact that in the execution of the developing step at a biasing voltage level of 250 V, it is necessary to set the grid voltage (Vg) at a level of 220 V which is lower than the developing voltage (Vb), resulting disadvantageously in a smaller potential difference: (Vg)−(Vi) of 70 V (220−150).

Generally speaking, in the normal copy mode, the adoption of an intentionally elevated bias voltage level is a counter measure against otherwise possible occurrence of toner fogging or fouling deposition which may occur frequently and result in decreased sensitivity of the photosensitive means, or when pale or colored background copy papers are used, thereby inviting a corresponding reduction in the concentration of the copy image produced. However, in the present third embodiment, the intended increase in the level of the developing bias voltage has nothing to do with the fogging or fouling phenomenon at all. In this way, the potential difference: (Vg)−(Vi) will result in a corresponding increase and thus, reversedly, a considerable rise in the concentration in the marginal image outlines produced.

Modifications

In the foregoing embodiments, the second charger, preferably in form of a scorotron charger 4 was impressed with a d.c. voltage having the opposite polarity to that which was impressed on the first charger 2 or 2'. However, it is also possible to use as the impressing voltage an alternating voltage in place of d.c. voltage.

In this case, and in the second charging step, the surface potential in the latent imaged areas will be reduced substantially to the grid voltage, however, with exception of those appearing at and along the marginal image outlines thereof, while the surface potential at the imageless background areas will rise substantially to the grid voltage.

Merits of the foregoing embodiments

In all of the foregoing embodiments, there is provided a second charger fitted with a grid and located between the image exposure unit and the developer unit, wherein the voltage impressed onto the second charger is either an alternating voltage or a d.c. voltage having an opposite polarity to that of the voltage impressed on the first charger. Further, the voltage impressed on the grid is selected to have the same polarity as that of the voltage impressed on the first charger and said grid voltage is lower than the surface potential in the imaged area(s) of the static latent image formed by the image exposure unit while being higher than the surface potential in the imageless background areas, resulting in the formation of a positive latent image(s) having toner disposited on the periperal edge portion thereof, and thus providing tonered positive peripheral edge lines. In addition, the copier machine according to the foregoing embodiments can be selectively operated either in a peripheral image outline formation mode by operation of said second charger, or in a normal copy mode by not operating said second charger, so that the user has an optional and convenient selection in this respect. In the peripheral image outline formation mode, the surface potential difference between the grid voltage at the second charger and the surface potential of the image areal latent image portion(s) in the background area(s) on the sensitive drum can be set to a substantially large value sufficient for providing sharp and clear and high quality peripheral image lines on the copy.

Fourth Embodiment

Figure 8:
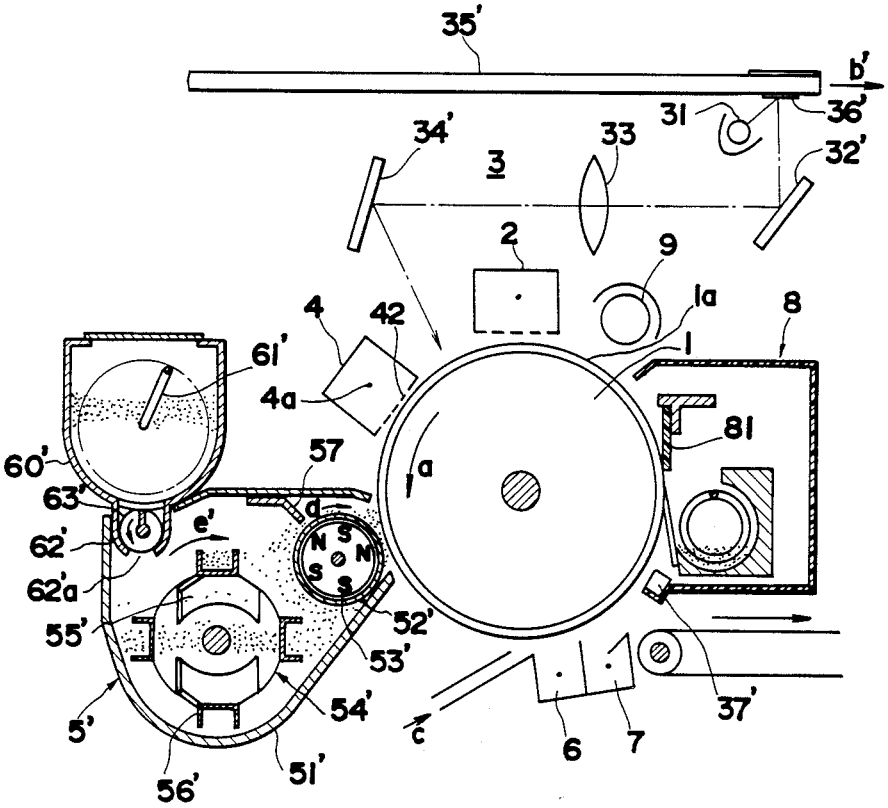
FIG. 8 is a view similar to FIG. 1, showing a third embodiment of the invention.

A schematic elevation of a further copier in the form of a fourth embodiment is shown in FIG. 8 which substantially corresponds to FIG. 1 and FIG. 6.

The photosensitive drum is designated by numeral 1, as before. However, numeral 1*a* designates the photoconductive layer. 2 designates a static charger as before, although its illustrated form is somewhat different from the foregoing one. Former charge wire 2*a* has been omitted for simplicity of the drawing. This charger 2 is adapted for applying a predetermined static charge to the drum surface and this charge is positive in this embodiment.

The structure and arrangement of image exposure unit 3 are substantially the same as before. In this embodiment, however, mirrors 32' and 34' are specifically shown, although in the foregoing first embodiment, they have been omitted from the drawing for simplicity.

Numeral 4 designates the scorotron charger shown in a rather simplified manner. The structure and arrangement thereof are substantially the same as before.

Numeral 5' designates the developer which has a rather specific structure and arrangement in comparison with the foregoing first embodiment, as will be later more fully described.

Numeral 6 designates a transfer charger as before, which applies an electric field to a copy paper, not shown, being conveyed in the direction shown by a small arrow c, from behind. This charger 6 serves for transferring therefrom the static latent image(s), not shown, formed on the drum surface and having the toner deposited thereon by the action of developer unit 5' conventionally.

Figure 12:
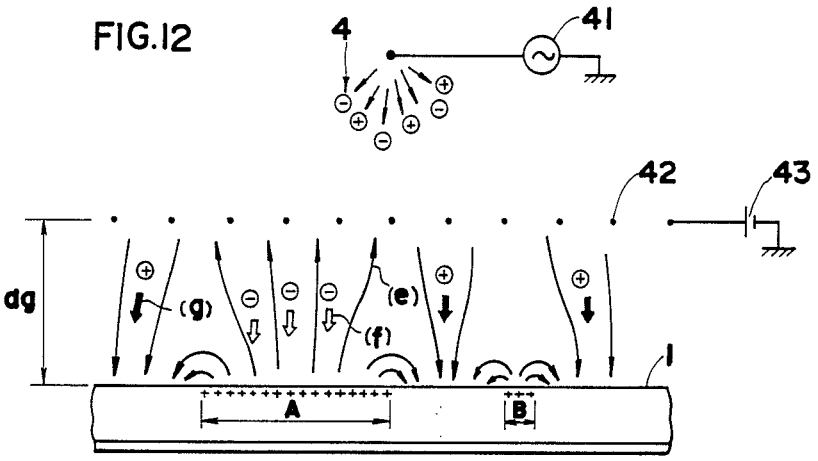
FIG. 12 is a similar view to FIG. 4, illustrating similar effects appearing in the fourth embodiment.

The scorotron charger 4 acting as the second static charger has a charge wire 4*a* which is electrically connected to voltage source 41, while the grid 42 is electrically connected with a voltage source, as is more specifically shown in FIG. 12. The present embodiment is utilized for exposure of a positive document and for forming therefrom positive marginal image outline(s). In this case, charge wire 4*a* of static charger 4 is impressed with an opposite polarity voltage to that impressed upon static charger 2. Further, numeral 7 designates a separation charger, the structure, arrangement as well as the functions thereof being substantially similar to the foregoing first embodiment.

Structure and functions of cleaner unit 8 as well as eraser lamp 9 are substantially same as before. On the grid 42 is impressed from voltage source 43, a voltage which has the same polarity as that impressed on static charger 2, and which is sufficiently lower than the surface potential in the imaged area(s) of the latent images on the drum and is, in addition, somewhat higher than the surface potential in the background area(s) thereof.

Developer unit 5' comprises a developing vessel 51' in which a developing sleeve ring 52' and a bucket roller 54' are provided. A toner dispenser 60' is mounted on the upper part of said vessel 51'.

Developing sleeve ring 52' is rotatably mounted in close proximity to photosensitive drum 1, the rotation direction of the former being shown by a small arrow d. Concentrically within developing sleeve ring 52', is provided a stationary magnetic roller 53' which is provided with an alternating series of separate N- and S-poles are. Although not shown, magnetic stationary roller 53' is electrically connected with a bias voltage source.

The developing agent consists of a mixture magnetic carrier and insulative toner, these components being charged to have opposite polarities by friction charging. In the process as adopted in the present embodiment, insulative toner is charged to have a reverse polarity to that of static charger 2. When the insulative toner is non-magnetic, developing sleeve ring 52' is energized from the developing bias with a bias source voltage which is somewhat higher than that which is applied to the grid and which has same polarity as that of static charger 2. The voltage value of the developing biasing source is set to a somewhat higher level than the surface potential prevailing in a substantial part of the latent image area(s) which has been lowered through corona discharge action at the scorotron charger 4 in the second charging step to be set forth hereinafter. The developing agent of the above kind is held as a kind of brush on the surface of developing sleeve ring 52' under the magnetic influence of magnetic roller 53' and then conveyed in the direction shown by a small arrow d by and with the rotary movement of the ring 52' for serving to develop the static latent image(s) formed on the sensitive drum surface.

In operation, bucket roller 54' will rotate in the direction shown by a small arrow e'. This roller 54' is provided with a plurality of agitating vanes 55' and fitted further with buckets 56' on its peripheral surface for take up of the developing agent present around the roller under consideration to convey it to the peripheral surface of developing sleeve ring 52'.

Figure 9:
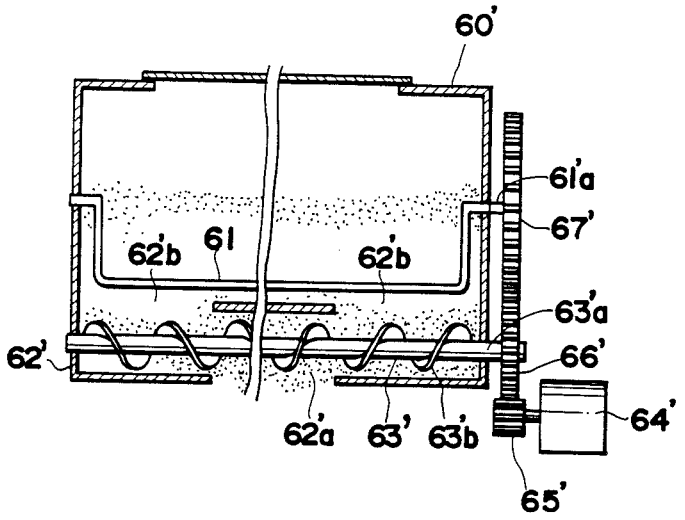
FIG. 9 is a sectional view of a developer dispenser used the third embodiment.
Figure 10:
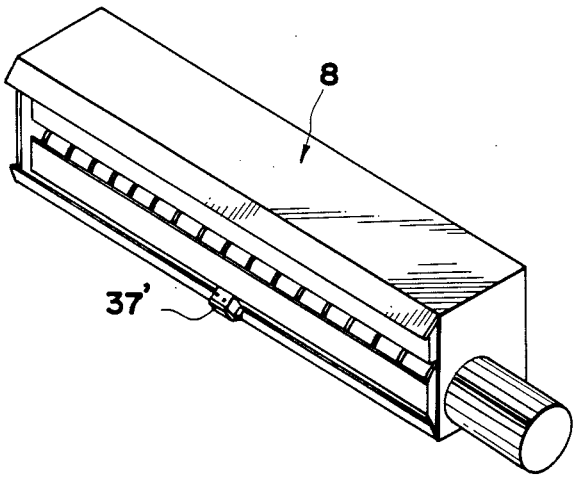
FIG. 10 is a perspective view of a cleaner used in the third embodiment of the invention.

Toner supply vessel 60' is fitted with a rotatable agitator rod 61' for the purpose of preventing occasional formation of toner bridges and blockings. At the bottom of toner supply vessel 60', there is a dispenser portion 62' having a dispensing opening 62'a. Dispenser portion 62' and the interior space of vessel 60' are kept in fluid communication through openings 62'b specifically shown in FIG. 9. There is an elongated spiral vane wheel 63' having in the inside space of dispenser portion 62' a spiral vane 63'b fixedly attached thereto, said wheel 63' being rotatably mounted at both ends at 62' as shown in FIG. 9. The halves of vane 63'b spiral in opposite directions for causing the toner to flow towards the central middle portion of the vane wheel. For structural and operational convenience, vane wheel 63' and agitating bar 61' are driven in synchronism with each other by a common drive motor 64'.

For this purpose, output pinion 65' of drivemotor 64' is kept in mesh with a gear 66' fixedly mounted at one end of shaft proper 63'a of vane wheel 63', said gear 66' meshing with a further gear 67' fixedly mounted at one end if supporting shaft 61'a of said agitator bar 61'. Upon rotation of spiral vane wheel 63', the toner contained in the reservoir 60' will be fed through supply opening 62'C to developing container vessel 51'.

The toner supply is controlled by an AIDC (a kind of automatic toner supply controller conventionally used). More specifically, there is provided a reflector type photosenser 37' which is positioned nearly at the bottom of a cleaner unit 8' and in opposition to an imaginary central peripheral line, not shown, on the drum surface 1a, the sensor being so designed and arranged to sense the deposited amount of the toner on the standard latent image of a predetermined constant potential, which is formed on the drum surface each time in advance of practical execution of the scheduled copying. Then, the practical and effective toner supply is carried into effect based upon the thus detected reference value.

The advance formation of the reference latent image is executed by exposure of a full-black reference chart 36' mounted on the transparent document table 35' slightly in front of the marginal line for the document mounting area. The term "front" may be well understood with reference to an arrow b' shown in FIG. 8.

As for the operation control panel usable in the present fourth embodiment, a similar one may be used as was shown in FIG. 2.

Figure 11:
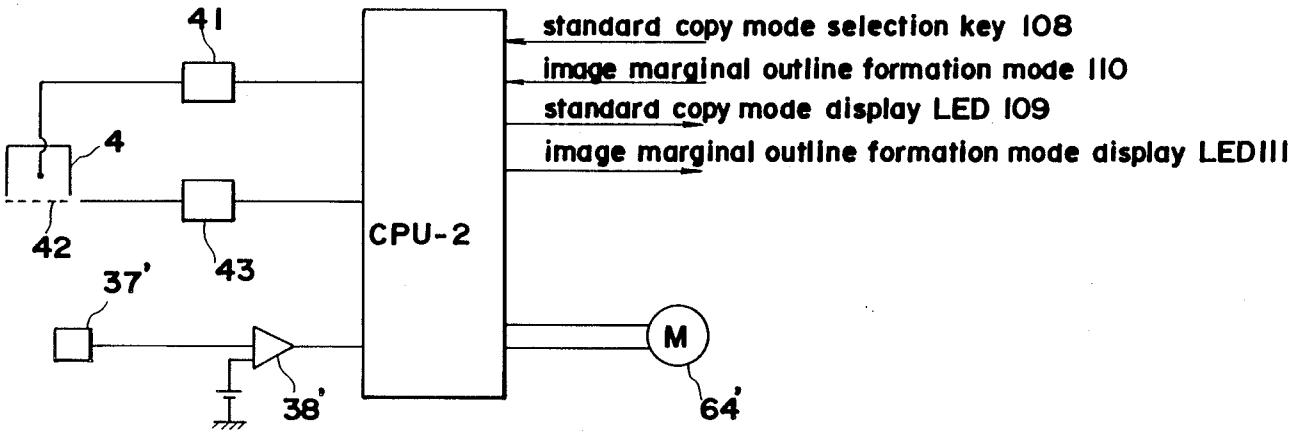
FIG. 11 is a block diagram of an operation control circuit employed in the third embodiment.

In FIG. 11, the control circuit of the present fourth embodiment is shown. The control operation thereof is executed through the intermediary of a microcomputer CPU-2.

The operation thereof will be illustrated with reference to FIG. 11 in combination with FIG. 2.

ON/OFF signals produced by operation of mode selection key 108; 110 are fed to computer CPU-2 as inputs, and ON/OFF signals therefrom are fed as outputs to display LEDs 109 and 111 and toner supply drive motor; and those for scorotron charger 4 are fed to voltage source 41 and those for grid 42; to voltage source 43. Further, detection signals from toner concentration detecting sensor 37' are fed as voltage values to comparator 38' for comparison relative to the reference value and the resulting higher or lower signals than the reference are fed to the computer CPU-2, FIG. 11.

In the following, polarities and voltages at the charger and the like, as adopted in the present embodiment will be given.

Static charger [source voltage]: positive, +5.5 kV;
Scorotron charger [source 41']: negative, −6.0 kV;
Grid voltage [source 43']: positive, +200 V;
Distance between grid and drum surface (dg): 1.5 mm;
Developing bias [source voltage]: positive, +300 V;
Transfer charger [source voltage]: positive, +5.5 kV;
Non-magnetic insulative toner: negative;

It should be noted that as an alternative measure the foregoing polarities can be reversed. Naturally, the foregoing numerical values have been given only by way of example.

Next, the image forming process will be set forth stepwise in the following:

Marginal image outline formation mode

This mode can be executed by depression of the selection key 110 to ON.

(i) First charging step:

By means of static charger 2, a preselected constant potential charge is applied to the drum surface. In the present embodiment, the drum surface potential amounts to +600 V.

(ii) Exposure step:

Document's positive images are exposured by the slit exposure system to the drum surface precharged at 600 V in the foregoing step, for the formation of corresponding latent images thereon. In this case, the 600 V potential in the imageless background areas will be decreased to +100 V or so under the influence of the foregoing light exposure step.

(iii) Second charging step:

Then, a recharging step is carried out by the action of scorotron charger 4 energized with a voltage of −6.0 kV from voltage source 41. At this stage, grid 42 is impressed to +200 V from voltage source 43. The polarity of the voltage impressed on scorotron charger 4 is opposite to that applied to static charger 2. Further, the voltage applied to grid 42 is the same in polarity as that which is applied to static charger 2 and the potential level is substantially lower than that the surface potential, +600 V, prevailing in the image areas on the drum surface, while being somewhat higher than the surface potential in the background areas thereof.

As a result, at the end of the second charging step, the desired positive or tonered latent image of the marginal image outlines corresponding to those of document's image area portions can be formed effectively.

(iv) Developing step:

The foregoingly formed static images of the desired peripheral outlines in the form of positive and tonered lines, obtained as a result of the second charging step is subjected, now, to a developing step under the action of developer 5' which has been somewhat modified from the foregoing unit 5 which was used in the first embodiment. In the present case, developing sleeve ring 52' is impressed with +300 V-developing bias. This developing bias voltage is of the same polarity as that of the voltage impressed on static charger 2 for effectively avoiding otherwise possible fouling and fogging toner deposit, not only in a substantial part of the static latent images, other than the marginal outline portions thereof, where the surface potential has been substantially lowered during the second charging step, but also in the imageless backgrounds. For the same purpose, the biasing voltage has been set to a somewhat higher level, Vb, than the said surface voltage at the said substantial part of the area of the image.

In this way, the negatively charged insulative toner will deposit at certain inner peripheral band zones extending insidely along the inside of the marginal image lines of the image portions appearing on the drum surface, having a higher potential level, and in the "from-inside trimming or -broidering way" so to speak, and indeed, by the normal developing mode.

Then, these tonered images are transferred onto the copy paper through a positive discharge at transfer charger 6. The transferred images on the copy paper will be fixed thereon after passage through a conventional fixer unit, not shown, to provide the finally fixed and copied images.

Standard copy mode

This mode will be executed by depression of said selection key 108. The initial control presettings are preset, even after voltage sources have been brought into service.

(i) First charging step:

This is the same as in the already set force marginal image outline formation mode.

(ii) Exposure step:

Substantially same as in the marginal image outline formation mode. Naturally, in this case, positive and tonered static images are obtained as before.

(iii) Second charging step:

Voltage sources 41 and 43 are turned to OFF, and thus scorotron charger 4 is not energized so that, the positive and tonered images will be forwarded to the next developing step.

(iv) Developing step:

This is substantially the same as in the foregoing marginal image outline formation mode. In this step, the toner is deposited naturally at the imaged portions, whereby regular tonered images having a one-to-one correspondence to the document's images are provided through a normal developing step. In this case, the developing bias is changed over to +230 V.

Figure 13:
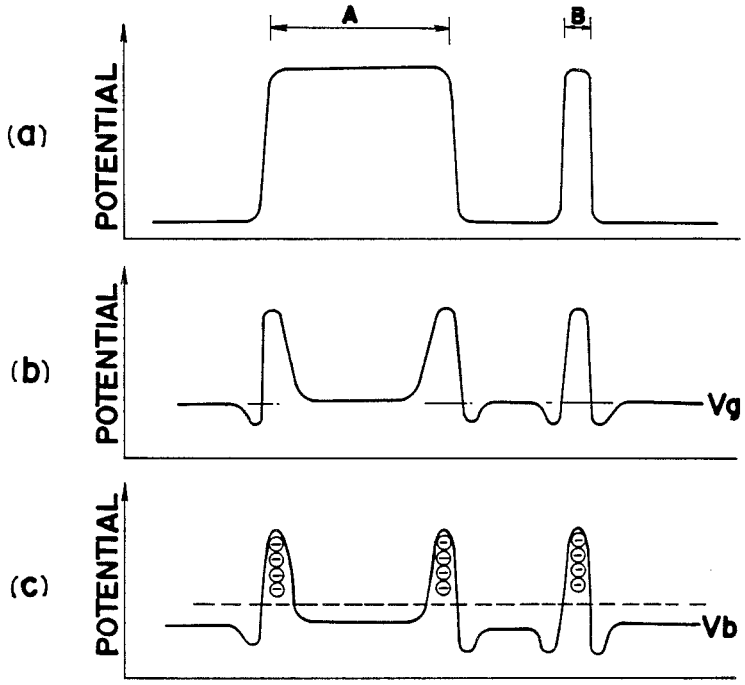
FIG. 13 is a similar view to FIG. 5, illustrating similar effects appearing in the fourth embodiment.

Next, referring to FIGS. 1, 12 and 13, a modification of the first embodiment will be set forth.

In this modification, charge wire 4*a* of scorotron charger 4 is supplied with an alternating voltage from the source 41 which is now an alternating voltage source.

Other polarity and voltage conditions are the same as in the first embodiment.

The a.c. voltage of the source 41 is set to AC ±6.0 kV when the used toner is non-magnetic insulative one. This condition will be the same for use of magnetic insulative toner.

In the following, the marginal image outline formation process will be set forth stepwise.

(i) First charging step:

With operation of the static charger, the drum surface is statically charged to a predetermined potential as before. The drum surface potential amounts to +600 V.

(ii) Exposure step:

This is substantially the same as in the first embodiment. The images on the document are slit-exposured onto the precharged drum surface, so as to form static latent images thereon. In this case, as shown at (a) of FIG. 13, the static charge in the imaged areas (A) and (B) remains at the level of +600 V, while that in the imageless background areas is reduced to +100 V or so, as a result of the light projection. As the document, a positive one has been used as in the first embodiment.

(iii) Second charging step:

In this case, an alternating voltage fed from the modified source, although denoted with the same reference numeral 41 as in FIG. 1, is impressed on scorotron charger 4 as is applied to the sensitive drum surface at 1, which has had formed thereon the static latent images, for the execution of a recharging step.

At this stage, grid 42 is impressed with a voltage of +200 V fed from voltage source 43. The voltage impressed on grid 42 is substantially lower than the surface potential +600 V in the statically formed latent image areas (A) and (B), yet is higher than the potential level +100 V in the imageless background areas and has the same polarity as employed in the foregoing first charging step.

Lines of electric force as shown by small arrows (e) are formed between the drum surface and grid 42. The negative and positive ions issuing from the charge wire impressed with the alternating voltage are subjected to carrying forces directed along such lines of electric force. As seen from FIG. 12, such lines of electric force which urge the negative ions towards the drum surface are generated above the central part of latent-image areas (A) and (B), other than an inside marginal band zone along the peripheral outline edge of each of these areas. Thus, the negative ions under consideration will impinge upon the said central part, other than said inside marginal zone or zones, as shown by small arrows (f) in FIG. 12. The potential at the negative-ion impinged area(s) will be lowered thus to +200 V or so, which is substantially equal to the grid voltage.

On the other hand, the positive ions will impinge upon the background area(s) outside of the peripheral zone of the image area (A), whereby the potential in the ion-impinged areas will rise to a value substantially equal to the grid voltage +200 V. When reviewing the drum surface potentials shown in FIG. 13(*b*), the foregoing phenomena can be more clearly understood based upon the foregoing description already set forth with reference to FIG. 5(*b*).

The final results from the deposition step can also be well understood FIG. 13(*c*), when reference is had to the foregoing description with reference to FIG. 5(*c*).

In the following, the operation of the first embodiment of the invention will be set forth with reference to flow sheets shown in FIGS. 14–17.

Figure 14:
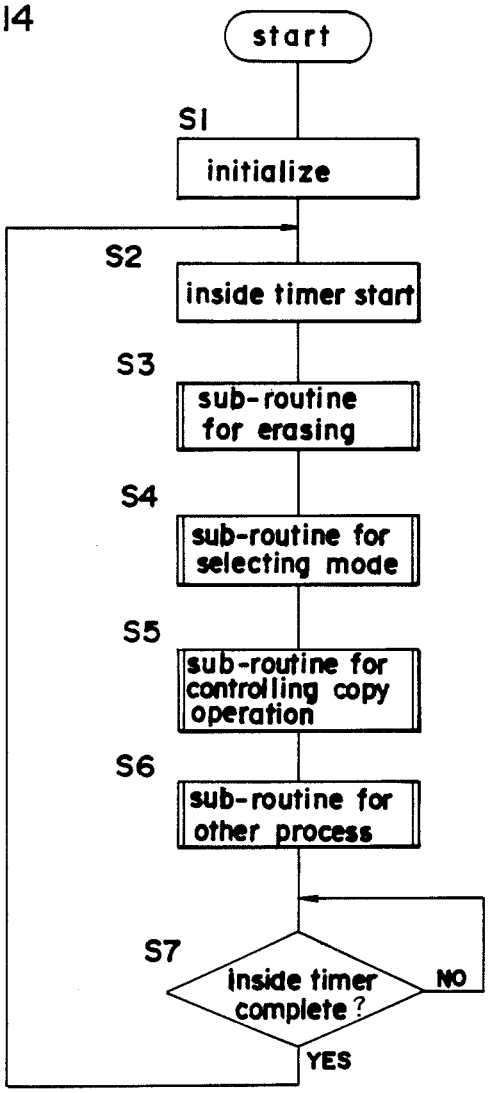
FIGS. 14–17 are several operational flow charts illustrating the operation of the copier according to the invention.

FIG. 14 illustrates a main routine of the microcomputer CPU 1.

When a power source, not shown, is turned ON, CPU-1 is reset to start the program. At step S1, RAM, not shown is cleared, various registers, not shown, are initialized and proper presetting of various units is brought about.

At step S2, an inside timer, not shown, will start its operation. Operation of this timer is independent of the operational contents of several subroutines to be described, the time limit of the former for determination of the necessary duration time of one routine of the main one being preset at the foregoing step S1.

Next, subroutines of steps S3-S6 are successively called for and when all the jobs have been executed, and at step 7 and at end of the foregoing inside timer's time limit, the operation will return to step 2. The specified time length of this one routine, is utilized for counting of various related timers raised in the above-mentioned subroutines.

The subroutine of step S3 is executed for removal of interimage residual charges. However, a description of the detailed operation thereof may be omitted without sacrificing better understanding of the inventive principles.

The subroutine of step S4 is provided for setting of a necessary copy mode as determined by ON/OFF manipulation of mode selection keys 108 and 110 on operation control panel 100 and for displaying the results thereon, as will be described more fully hereinafter.

The subroutine of step S5 serves for execution of copying control. Upon depressing the print key 101 to ON, the copying job according to the copy mode as was selected in the foregoing step S4 will be brought about. It should be noted, however, that if various other keys on the panel 100 should not be operated within a predetermined time period upon completion of the copying job especially in the marginal images outline formation mode preselected, the operative condition of the copier machine will return automatically to the other or normal copy mode, as will be later more fully described.

The subroutine of step S6 serves for execution of other jobs, preferably depositing temperature control. However, the details thereof may be omitted herefrom without sacrificing better understanding of the invention.

Figure 15:
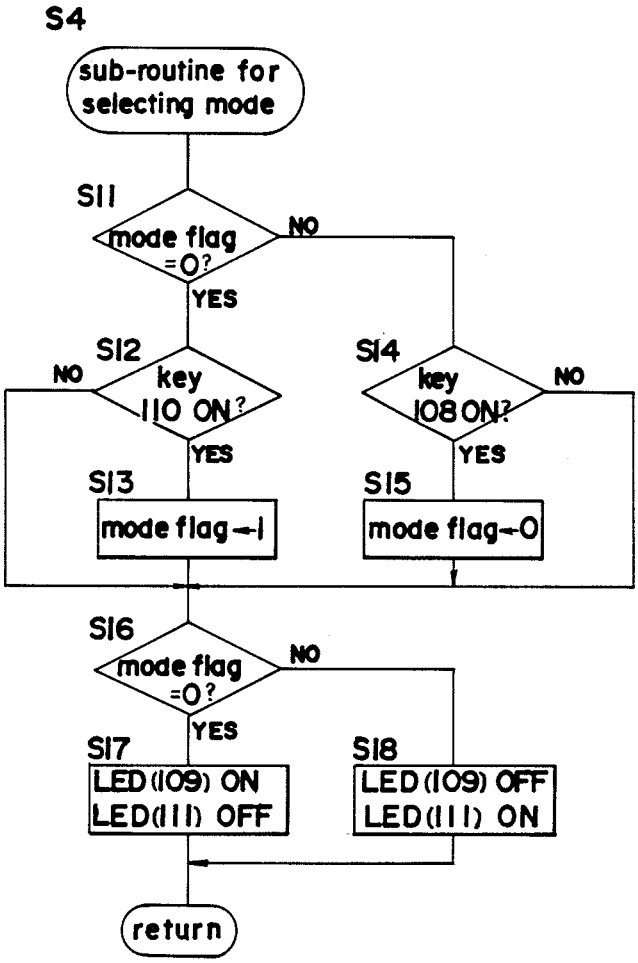

In FIG. 15, a subroutine for execution of mode selection which was made at step S4 is shown.

First, at step S11, whether the mode display has been reset to "0" or not is adjudged. If "0" is judged, operation progresses to steps S12. Or alternatively, if the flag shows "1", the operation will be progresses to step S14.

At step S12, it is adjudged if marginal image outline formation mode key 110 is ON or not. If ON, mode flag is set to "1" at step S13.

Further, at step S14, it is adjudged if normal and standard copy mode selection key 108 is ON or not. If ON, mode flag is set to "0" at step S15. In other words, when either of mode selection keys 108 or 110 is ON, the copy mode so selected is set. With initiation of the current supply from the source, not shown, the mode flag is set at step S1 automatically to "0", whereby the standard copy mode is preset automatically without ON-operation of the selection key 108.

At step S16, it is adjudged if the mode flag is at "0" or not. If 0, which means that normal and standard copy mode has been selected, standard copy mode display LED 109 becomes ON at step S17, while marginal image outline formation mode display LED 111 becomes OFF, thus the operation returning back to the main routine. On the other hand, if the mode flag shows "0", or more specifically, marginal image outline formation mode has been selected, LED 109 becomes OFF at step S18, LED 111 becomes ON, and further operation will return back to the main routine.

Figure 16:
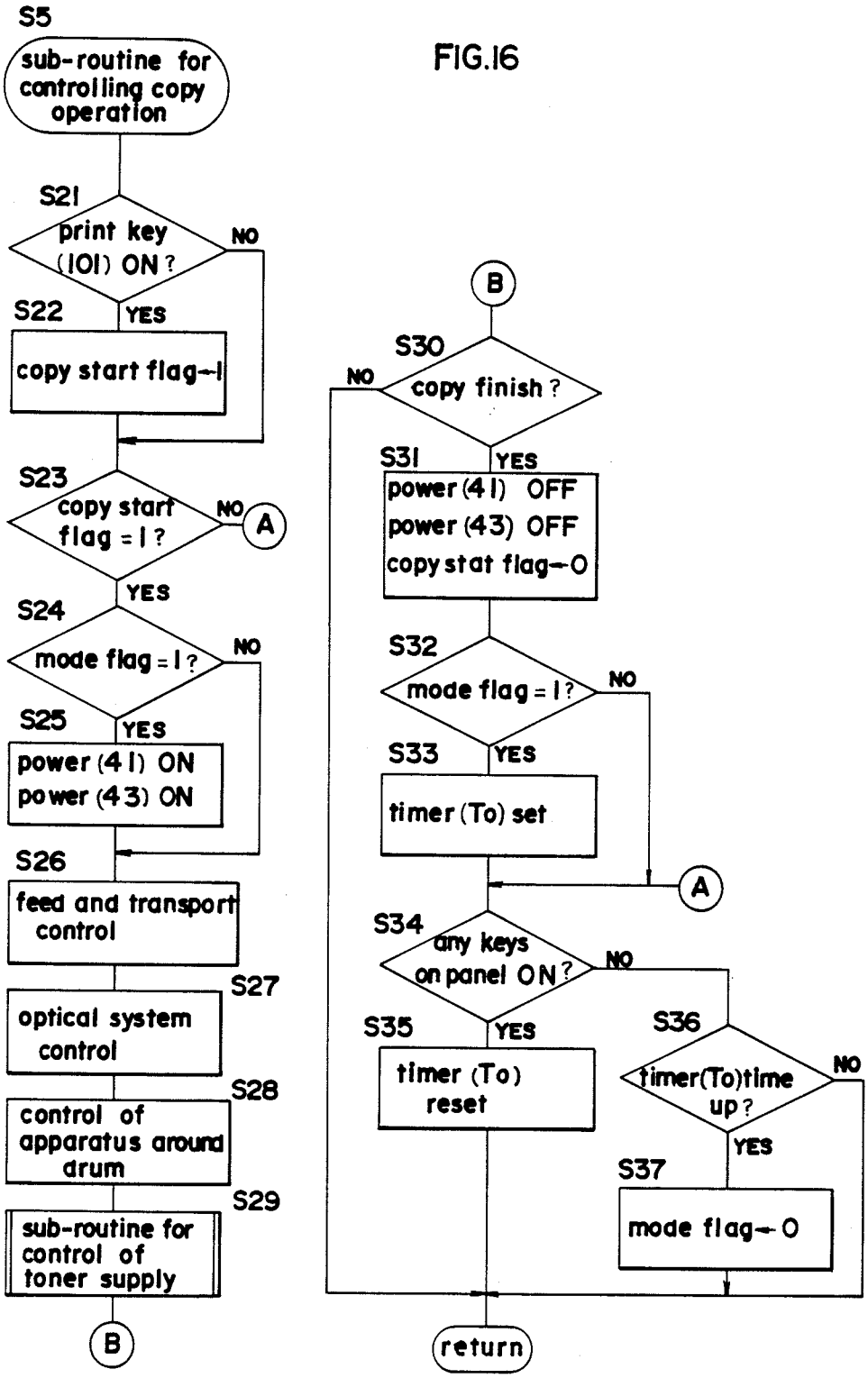

FIG. 16 represents a subroutine for execution of copying operation control at step S5.

First, at step S21, it is adjudged that print key 101 has been kept ON, and the operation advances forward to step S23. On the contrary, if ON, copy start flag is set to "1" at step S22, and the operation proceeds to step S23. In this way, the copy start flag is set to "1" at ON of print key 101 and will be reset to "0" upon completion of the copying operation and at step S31.

Next, at step S23, it is adjudged if copy start flag is kept at "1" or not. If the flag has been reset to "0", the operation will proceed to step S34 to be described. On the other hand, if the flag has been set to "1", it is further adjudged if mode flag has been set to "1" for showing preselection of the image outline formation mode. If true, voltage source 41 of scorotron charger as well as grid voltage source 43 are turned ON at step S25. If the normal copy mode should have been preselected, these voltage sources remain OFF.

Further at step S26, controls of paper feed and conveying operation are brought about.

At step S27, control of optical system 3 is performed.

At step S28, static charges, developer unit and the like arranged around the photosensitive drum 1, are subjected to control.

Since these controls are conventional and well known, further detailed description thereof may be omitted without impairing a better understanding of the invention.

Further, at step S29, the subroutine for toner supply control is called for, which will be more fully set forth hereinafter.

At step S30, it is adjudged if the copying operation has been terminated or not. If not yet terminated, the operation will be returned back to the main routine. On the contrary, if terminated, voltge sources 41; 43 are turned OFF and copy start flag is set to "0" at step S31.

Further, at step S32, it is adjudged if mode flag is kept at "1" or not. If not "1", which fact means that normal copy mode has been executed, the operation is advanced further to step S34. On the contrary, if "1", which means that marginal image outline formation mode has been executed, timer T0 is set to step S33, and then, the operation proceeds to step S34.

At step S34, it is adjudged if any one of keys the on operation control panel 100 has been pressed down to ON. If ON, timer T0 is reset at step S35, thereby the operation proceeding back to the main routine. If any one of keys is at ON, it is adjudged if timer T0 has been timed up at steps S36 or not. Thereupon, mode flag is set to "0" at step S37. In other words, if the marginal image outline formation mode has been selected but nevertheless, none of the function control keys on the panel 100 has been changed to ON within a predetermined time limit preset at timer T0 and after completion of the copying job, the operation is automatically changed over to normal copy mode. By adoption of the foregoingly described automatic measure, occasional occurrence of undesired execution of the marginal image outline formation mode is the next succeeding copying operation can definitely be avoided.

Figure 17:
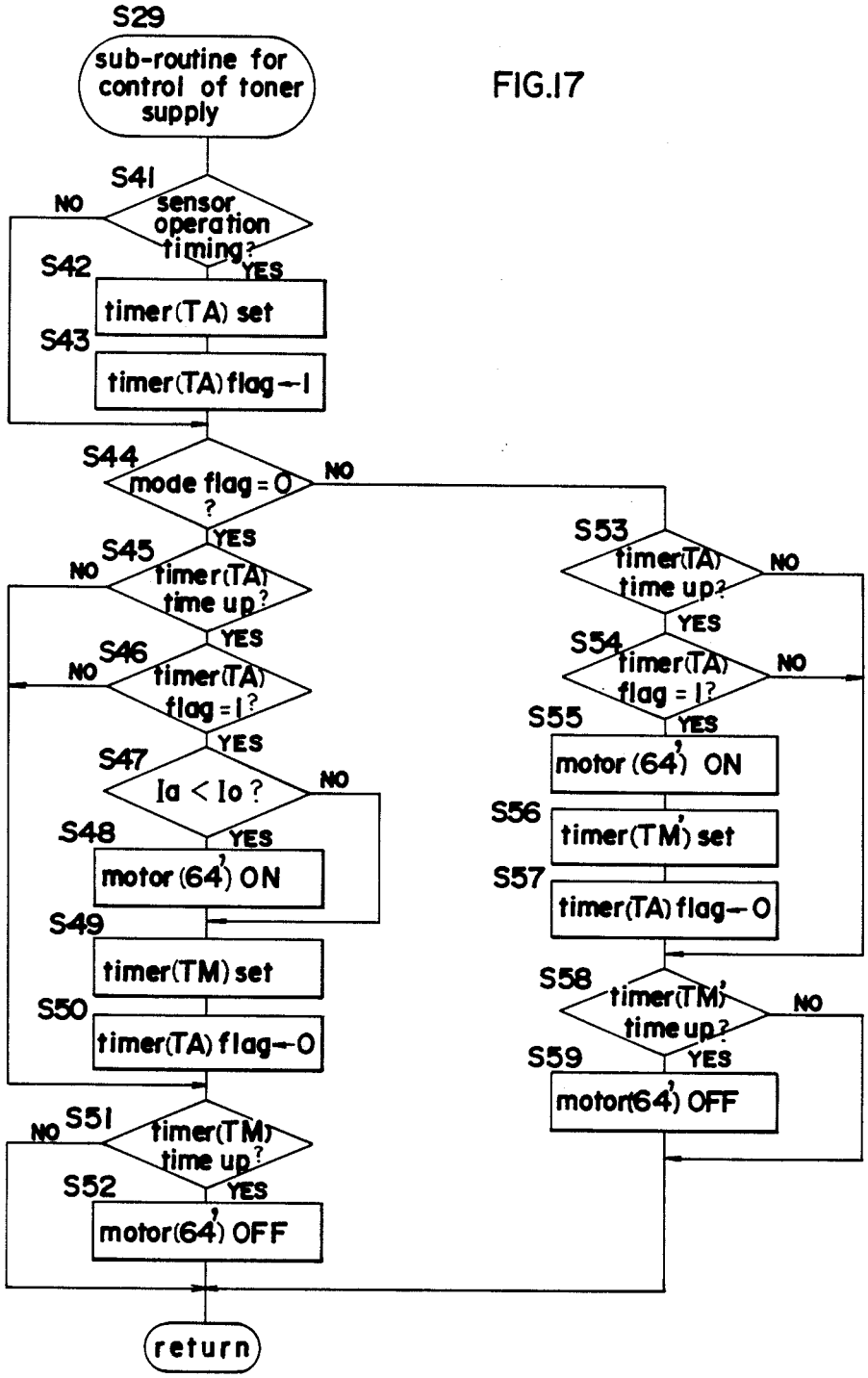

FIG. 17 represents a subroutine for the execution of toner supply control to be executed at step S29.

First, at step S41, it is adjudged whether the operation timing at the sensor 37' has been completed or not. If not, the operation progresses to step S44. On the contrary, if the operation timing has finished, timer TA is set at step S42 and then the timer flag for TA is set to "1" at step S43, the operation progressing thus to step S44. The time limit preset at the timer TA is a time which extends from the time of reference latent image formation on the drum surface at 1 to time at which the thus formed reference latent image is sensed by toner concentration detecting sensor 37' upon rotational movement of the drum.

At step S44, it is adjudged if mode flag is at "0" or not. If "0", or in other words, in the case of normal copy mode selection, operations at steps S45 and further are brought into execution. If "1", or in other words, if marginal image outline mode has been preselected, operations at steps S53 and further are brought into execution.

In the case when standard or normal copy mode has been selected, it is adjudged at step S45 that time TA has timed up or not and at step S46 if timer flag for TA is kept at "1" or not. If these both are NO, the operation proceeds to step S51. If these both are YES, comparison is made at the time-out of timer TA between the sensed toner concentration Ia sensed by sensor 37' at step S47 and the reference concentration I0. If the toner concentration Ia is higher than reference one I0, the operation proceeds to step S49. On the contrary, if Ia is lower than I0, toner supply motor 64' becomes ON at step S48 for initiating the toner supply, and the operation proceeds to step S49.

Next, timer TM is set for determining the driving period of motor 64' at step S49, or in other words the duration of toner supplement supply. Then, at step S50, timer flag for TA is reset to "0" and the operation progresses to step S51. Timer TM is so designed and arranged that it becomes timed out during execution of a copying job for a sheet of copy paper, and to say more specifically to be 4 seconds in the present embodiment. During this time period, about 200 mg of toner is supplied.

Further, at step S51, it is adjudged whether timer TM has timed out or not. When timed out, motor 64' is turned OFF at step S52, and then, the operation will return back to the subroutine of step S5. If, in advance of time-out, the operation will return through subroutine for step of S5 as well as the main routine back again to the present toner supply control subroutine. In this case, the judgement is made by reliance on such operating conditions, as NO at step S41; YES at steps S44 and S45 and NO at step S46, and then, it is adjudged again at step S51 if the timer TM has timed out or not.

When the marginal image outline formation mode has been preselected, it is adjudged at step S53 whether timer TA which was set at step S42 is timed out or not and that at step S54, the timer flag for TA is held at "1" or not.

If the both are NO, the operation progresses to step S58. On the contrary, if the both are YES, or in other words, when timer TA has timed out, motor 64' is brought ON at step S55, for initiating the toner supply. And then, at step S56, timer TM' for determination of the driving period of motor 64' which controls the toner supply period is set, and at step S57, timer flag for TA is set to "0", whereby the operation progresses forward to step S58. The time limit of timer TM' is preset to a substantially shorter time period than that preset at the foregoing timer TM, being 0.4 second in the present embodiment. During this time period, about 20 mg of toner is supplied. And it should be noted that this toner supply is executed, irrespective of the signal level from toner concentration detecting sensor 37' and quantitively for each copy paper sheet.

Further, at step S58, it is adjudged whether timer TM' has been timed out or not. If timed out, motor 64' is turned OFF at step S59, and then the operation is returned to subroutine at step S5. If, in advance of time out, the operation will be returned through subroutine of step S5 and the main routine, back again to the subroutine for toner supply control. In this case, the adjudgement whether timer TM' has timed out or not is made from such conditions as steps S40 and S44 being NO; step S53 being YES and step S54 being NO. And, whether the timer TM' has timed out or not, is adjudged again at step S58.

In other words, in the normal copy mode, the toner supplying operation is ON/OFF-controlled depending upon the output from toner concentration detecting sensor 37'.

On the other hand, in the marginal image outline formation mode, a small and constant quantity of toner is supplied irrespective of output from the sensor 37'. In this copying mode, the reference image is also formed only in its outline configuration, so that only a small toner quantity is deposited. It may thus be feared that the sensor 37' senses always a toner concentration lower than optimum. However, in the present embodiment, only a small and constant toner quantity is supplied for each copying job, so that the feared toner over-deposition is positively prevented. The lesser and constant toner supply quantity of about 20 mg which is substantially smaller than the mean toner consumption quantity of 40–50 mg is based on the observation that in the marginal image outline formation mode, the development is only of the outlines, so that the practical toner consumption rate is sufficient if only a substantially lower rate.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

As an example, although the photosensitive means have been shown as a rotatable drum in the foregoing several embodiments, said drum can be replaced by a reciprocating sheet or plate or the like member.

What is claimed is:

1. An electrophotographic copier for copying in an image outline copying mode or a normal full image copying mode, said copier comprising:

an electrostatic image bearing member;

a first charging means for charging said electrostatic image bearing member to a predetermined potential of a specific polarity;

an exposure means for exposing the charged electrostatic latent image bearing member to a positive image to thereby form a positive electrostatic latent image of said image bearing member;

a second charging means for recharging the electrostatic latent image bearing member on which the positive electrostatic latent image has been formed, said second charging means having a grid and means to supply said grid with a potential of the same polarity as that applied to said first charging means and which potential is substantially lower than the surface potential of the image portion of the latent image and which potential is further slightly higher than the surface potential of the imageless background portion of the electrostatic latent image, whereby an outline portion of the latent image is given a higher potential than the other portions thereof;

a developing means for developing the electrostatic latent image recharged by the second charging means or the electrostatic image formed on the latent image bearing member by exposure to said exposure means by using a potential slightly higher than the potential of said second charging means and a toner charged to a polarity opposite to that applied to said first charging means;

an energizing means for causing said copier to operate through a cycle of a copying operation; and an image outline copying mode designating means for, when copying only the outline portion of the positive image is desired, causes said second charging means to be operated during the copying operating cycle between the time of operation of said exposure means and the time of operation of said developing means; and a normal full image copying mode designating means for, when normal copying is desired, causes said second charging means not to operate.

2. A copier as claimed in claim 1 wherein said second charging means comprises an electrostatic charger and means for applying a DC voltage to said charger, which voltage has a polarity opposite to that applied to said first charging means.

3. A copier as claimed in claim 1 wherein said second charging means comprises an electrostatic charger and means for applying an alternating current voltage to said charger for raising the background potential of the electrostatic latent image to a potential approximately equal to the voltage of said grid.

4. A copier as claimed in claim 1 wherein said exposure means includes timing means for controlling the length of exposure time at a longer period of time suitable for image outline copying and a shorter period of time suitable for normal full image copying, and the respective designating means are connected to said timing means for causing said timing means to operate for the longer period of time when said image outline copying mode designating means is actuated, and for causing said timing means to operate for the shorter period of time when said normal full image copying mode designating means is actuated.

5. A copier as claimed in claim 1 wherein said first charging means is operable for providing a lower amount of charge suitable for image outline copying and a higher amount of charge suitable for normal full image copying, and the respective designating means are connected to said first charging means for causing said first charging means to provide the lower amount of charge when said image outline copying mode designating means is actuated, and for causing said first charging means to provide the higher amount of charge when said normal full image copying mode designating means is actuated.

6. A copier as claimed in claim 1 further comprising control means for, even when said image outline copying designating means has been actuated for a preceding copying operation, automatically changing the designation of the image outline copying mode to the normal full image copying mode when a predetermined time period has elapsed after completion or termination of a copying operation in the image outline copying mode.

7. A copier as claimed in claim 1 further comprising further control means for automatically causing said full normal image copying mode to be designated upon first energizing of said copier.

8. A copier as claimed in claim 1 further comprising a developing bias means connected to said developing means for applying to said developing means a biasing voltage with a polarity the same as that of the potential of said first charging means.

9. A copier as claimed in claim 8 wherein said developing bias means comprises means for supplying a higher bias voltage suitable for image outline copying and a lower bias voltage suitable for normal full image copying, and the respective designating means are connected to said bias means for causing said bias means to provide the higher bias voltage when said image outline copying mode designating means is actuated, and for causing said bias means to provide the lower bias voltage when said normal full image copying mode designating means is actuated.

10. In an electrophotographic copier having:

an electrostatic image bearing member;

a first charging means for charging said electrostatic image bearing member with a predetermined potential of a specific polarity;

an exposure means for exposing the charged electrostatic latent image bearing member to a positive image to thereby form a positive electrostatic latent image;

a developing means for developing the electrostatic latent image formed by said exposure means;

an energizing means for energizing said copier for causing it to go through a cycle of a copying operation; and a normal full image copying mode designating means for causing said copier to operate to develop the electrostatic image produced by said first charging means;

the improvement comprising:

a second charging means between said exposure means and said developing means for recharging the electrostatic latent image bearing member having a positive electrostatic latent image thereon, said second charging means having a grid and means to supply said grid with a potential of the same polarity as that applied to the first charging means and which potential is substantially lower than the surface potential of the image portion of the latent image and which potential is further slightly higher than the surface potential of the imageless background portion of the electrostatic latent image, whereby an outline portion of the latent image is given a higher potential than the other portions thereof; and an image outline copying mode designating means for causing said second charging means to operate when it is desired to operate said copier in the image outline copying mode for causing said developing means to develop the image outline of the image by normal development using a potential slightly higher than the potential of said second charging means and a toner charged to a polarity opposite the polarity of the charge applied by said first charging means.

* * * * *